US007602112B2

(12) United States Patent
Peeters et al.

(10) Patent No.: US 7,602,112 B2
(45) Date of Patent: Oct. 13, 2009

(54) ASSEMBLY OF A CAPPED HIGH-PRESSURE DISCHARGE LAMP AND A LAMP HOLDER

(75) Inventors: Nicholas Gerardus Antonius Peeters, Eindhoven (NL); Johannes Antonius Theresia Schellen, Turnhout (BE); Karl-Wilhelm Vogt, Ense-Hoingen (DE); Erwin Norbert Lingemann, Arnsberg (DE)

(73) Assignees: Koninklijke Philips Electronics N.V., Eindhoven (NL); BJB GmbH & Co. KG, Arnsberg (DE)

( * ) Notice: Subject to any disclaimer, the term of this patent is extended or adjusted under 35 U.S.C. 154(b) by 290 days.

(21) Appl. No.: 10/598,996

(22) PCT Filed: Mar. 8, 2005

(86) PCT No.: PCT/IB2005/050851

§ 371 (c)(1),
(2), (4) Date: Sep. 18, 2006

(87) PCT Pub. No.: WO2005/093774

PCT Pub. Date: Oct. 6, 2005

(65) Prior Publication Data

US 2008/0129179 A1 Jun. 5, 2008

(30) Foreign Application Priority Data

Mar. 22, 2004 (EP) ..... 04101173

(51) Int. Cl.

| | |
|---|---|
| ***H01J 5/48*** | (2006.01) |
| ***H01J 5/50*** | (2006.01) |
| *H01J 11/00* | (2006.01) |
| *H01J 17/00* | (2006.01) |
| *H01J 61/00* | (2006.01) |
| *H01J 61/28* | (2006.01) |
| *H01K 1/50* | (2006.01) |

(52) U.S. Cl. ..... 313/318.07; 313/318.01; 313/318.05; 313/318.09; 439/611; 439/612; 439/613; 439/602; 439/619; 439/699.2; 439/356; 439/918; 439/645; 439/646; 439/56; 439/236; 439/226; 439/617; 315/56; 315/57; 315/58; 362/514; 362/516; 362/548; 362/549; 362/226

(58) Field of Classification Search ..... 439/611–613, 439/602, 619, 699.2, 356, 918, 645, 646, 439/56, 236, 226, 617; 313/138.07, 623; 315/56–58; 362/514, 516, 548, 549, 226
See application file for complete search history.

(56) References Cited

U.S. PATENT DOCUMENTS 3,885,149 A * 5/1975 Wolfe et al. ..... 362/211

(Continued)

FOREIGN PATENT DOCUMENTS

| | | |
|---|---|---|
| EP | 0478077 A1 | 4/1992 |
| EP | 0478078 A1 | 4/1992 |
| EP | 0778640 A1 | 6/1997 |

*Primary Examiner*—Toan Ton
*Assistant Examiner*—Zachary Snyder

(57) ABSTRACT

The invention relates to an assembly of a capped high-pressure discharge lamp (1) and a lamp holder (50). The discharge lamp comprises an outer envelope (10) in which a discharge vessel (11) is arranged. The outer envelope has a pinched portion (20) provided with a clamping member (25). A lamp cap comprises a substantially circular-cylindrical cup shaped portion for receiving the clamping member and is provided with a protruding collar (36). The lamp holder (50) comprises a substantially circular-cylindrical flange (55) for receiving the cup-shaped portion such that the flange engages the protruding collar. An inner diameter of the flange (55) has a tolerance of less than or equal to −0.2 mm. An outer diameter of the cup-shaped portion (33) has a tolerance of less than or equal to +0.2 mm. The respective tolerances extend over a length of at least 2.5 mm, measured with respect to the protruding collar.

15 Claims, 4 Drawing Sheets

U.S. PATENT DOCUMENTS 4,785,218 A * 11/1988 Kohl et al. ..... 313/579
4,864,183 A * 9/1989 Okano ..... 313/318.1
5,677,589 A 10/1997 Westemeyer
6,010,350 A 1/2000 Henrici et al.
6,080,019 A * 6/2000 Coushaine ..... 439/611
6,469,428 B1 10/2002 Thiel et al.
2002/0003391 A1 * 1/2002 Tsuda et al. ..... 313/318.01

* cited by examiner

ASSEMBLY OF A CAPPED HIGH-PRESSURE DISCHARGE LAMP AND A LAMP HOLDER

The invention relates to an assembly of a capped high-pressure discharge lamp and a lamp holder.

The invention also relates to a capped high-pressure discharge lamp for use in such an assembly.

The invention further relates to a lamp holder for use in such an assembly.

High-pressure discharge lamps can have a high color temperature, a high color rendering index and a high brightness; these lamps are highly suitable for applications requiring a compact light source in order to form a beam in conjunction with a reflector, for example, for road illumination, for studio or projection purposes, for professional indoor lighting, for instance in shops and in industry, and for city beautification.

High-pressure discharge lamps of the kind mentioned in the opening paragraph either have a discharge vessel with a ceramic wall or a quartz glass discharge vessel. Such high-pressure discharge lamps are widely used in practice and combine a high luminous efficacy with favorable color properties. The discharge vessel of the lamp contains one or several metals or metal halides in addition to Hg and a rare gas filling.

A ceramic wall in the present description and claims is understood to be a wall made from one of the following materials: mono-crystalline metal oxide (for example sapphire), densely sintered polycrystalline metal oxide (for example aluminum oxide, YAG), and densely sintered polycrystalline metal nitride (for example aluminum nitride).

A capped high-pressure discharge lamp and a lamp holder for use with such a discharge lamp are known from European patent application EP-A 0 478 078. The capped high-pressure discharge lamp has a lamp cap of insulating material provided with a centrally disposed contact member and with a metal sleeve concentric thereto. A first end of the discharge vessel is mounted within the metal sleeve and a current supply conductor is attached to the metal sleeve. The rotationally symmetrical geometry of the cap allows insertion of the high-pressure discharge lamp into the lamp holder in a rotational position.

A disadvantage of the known assembly of a capped high-pressure discharge lamp and a lamp holder is that it forms a system of fits, in which the position of the capped high-pressure discharge lamp in the lamp holder is relatively inaccurate. This implies that the center of the light discharge is not known with sufficient accuracy.

The invention has for its object to eliminate the above disadvantage wholly or partly. This object is achieved according to the invention by an assembly of a capped high pressure discharge lamp and a lamp holder, the capped high-pressure discharge lamp comprising:

an outer envelope in which a discharge vessel is arranged around a longitudinal axis, the discharge vessel enclosing, in a gastight manner, a discharge space provided with an ionizable filling, the discharge vessel having a first connection portion and a second opposite connection portion through which a first and a second current-supply conductor, respectively, extend to a pair of electrodes arranged in the discharge space, the outer envelope having a pinched portion supporting the discharge vessel via the first and second current-supply conductors, the pinched portion being provided with a clamping member surrounding the pinched portion with a clamping fit, a lamp cap having a base portion of an insulating material and a substantially circular-cylindrical cup-shaped portion for receiving the clamping member, the cup-shaped portion being provided with a protruding collar, the base portion being provided with a first and a second contact member projecting beyond the cup-shaped portion, the first and second current-supply conductors being electrically connected to the first and second contact members, respectively, the lamp holder comprising:

a base portion and a substantially circular-cylindrical flange for receiving the cup-shaped portion of the capped high-pressure discharge lamp, the base portion being provided with first and second connection means, wherein the flange of the lamp holder receives the cup-shaped portion of the capped high-pressure discharge lamp such that the flange engages the protruding collar of the cup-shaped portion and the first and second contact members make electrical contact with the first and second connection means, respectively, an inner diameter of the flange having a tolerance of less than or equal to −0.2 mm, an outer diameter of the cup-shaped portion having a tolerance of less than or equal to +0.2 mm, the respective tolerances extending over a length of at least 2.5 mm, measured with respect to the protruding collar along the longitudinal axis.

Specifying relatively narrow tolerances for the respective diameters of the flange of the lamp holder and the cup-shaped portion enables accurate positioning of the cup-shaped portion into the flange. In this manner, the discharge vessel of the capped high-pressure discharge lamp is positioned with relatively high accuracy in the lamp holder. The center of light of the discharge is located on the longitudinal axis with relatively high accuracy. In addition, the position of the center of the light discharge on the longitudinal axis, i.e. the distance of the center of the light discharge with respect to a reference (point) on the lamp holder, can be determined with relatively high accuracy. This distance is also referred to as the "light-center length" of the discharge. A relatively well-defined light-center length of the light emitted by the discharge in the discharge vessel of the capped high-pressure discharge lamp is obtained with the assembly according to the invention. Such accurate positioning of the high-pressure discharge lamp with respect to the lamp holder is helpful when the assembly of the high-pressure discharge lamp and the lamp holder is mounted in a reflector. This is in particular the case when the beam (pattern) emitted by the reflector has to be well defined such as, by way of example on roads where vehicles travel in opposite directions and glare towards the drivers has to be avoided. In addition, there is a tendency in the market to diminish the size of the lamps and the lamp holders. This tendency amplifies the need for accurate positioning of (discharge) lamps in their respective lamp holders.

Upon receiving the cup-shaped portion of the capped high-pressure discharge lamp, the flange of the lamp holder engages the protruding collar of the cup-shaped portion. This engaging relationship between the cup-shaped portion and the flange determines the height of the discharge lamp with respect to the lamp holder. In this manner the light-center length along the longitudinal axis is accurately determined. The position of the center of the light discharge in a plane perpendicular to the longitudinal axis is determined by the tolerances of the respective diameters of the flange of the lamp holder and the cup-shaped portion. The higher the requirement concerning the tolerance of the respective diameters, the better the center of the light discharge is positioned on the longitudinal axis.

In the known assembly, a lamp cap of an insulating material is fastened to a first connection portion of the lamp vessel and provided with a first, central contact member. The lamp cap has a substantially rotationally symmetrical metal sleeve around the first connection portion of the lamp vessel, which sleeve is substantially concentric with the first contact member, and the first connection portion is fixed within said sleeve. The metal sleeve has a continuous circular relief in the form of a circumferential groove with which retention means of the lamp holder can engage or a clamping terminal of the lamp holder for making electrical contact. In the known assembly the position of the capped high-pressure discharge lamp in the lamp holder is relatively inaccurate. The capped high-pressure discharge lamp can easily move in the known lamp holder, giving relatively large inaccuracies in the position of the center of the discharge with respect to the longitudinal axis and with respect to the lamp holder.

In the assembly according to the invention the base portion is the reference plane for the system of fits. The accuracy is obtained, on the one hand, by the relatively small tolerances on the height of the lamp holder and the relatively small tolerances on the flange and, on the other hand, by the small tolerances on the outer diameter of the cup-shaped portion and the protruding collar, which both are used as the reference during the adjustment of the burner in the manufacturing process.

Preferably, the inner diameter of the flange has a tolerance of less than or equal to −0.10 mm and the outer diameter of the cup-shaped portion has a tolerance of less than or equal to +0.05 mm, the respective tolerances extending over a length of at least 5 mm, measured with respect to the protruding collar along the longitudinal axis. Specifying relatively narrow tolerances for the respective diameters of the flange of the lamp holder and the cup-shaped portion enables the positioning of the cup-shaped portion into the flange with relatively high accuracy. In this manner, the discharge vessel of the capped high-pressure discharge lamp is positioned with relatively high accuracy in the lamp holder. A very accurate light-center length of the light emitted by the discharge in the discharge vessel of the capped high-pressure discharge lamp is obtained with the assembly according to the preferred embodiment of the invention. The higher the requirement imposed for the tolerances of the respective diameters, the better the center of the light discharge is positioned on the longitudinal axis.

In order to further improve the accuracy of the position of the cup-shaped portion of the capped high-pressure discharge lamp in the flange of the lamp holder, the mounting of the clamping member in the lamp cap can be improved. To this end, a preferred embodiment of the assembly according to the invention is characterized in that the clamping member is provided with a substantially circular-cylindrical engagement portion for fixing the clamping member in the cup-shaped portion. This engagement portion enhances the fit of the clamping member in the cup-shaped portion. In addition, the engagement portion can be used to provide a rigid connection, for instance by spot welding, between the clamping member and the cup-shaped portion.

A preferred embodiment of the assembly according to the invention is characterized in that the cup-shaped portion of the lamp cap and the flange of the lamp holder are made from a metal. The use of metal provides that the relatively narrow tolerances of the diameters of the inner diameter of the flange and the outer diameter of the cup-shaped portion can be achieved. In addition, because of the relatively high temperatures of the discharge lamp the use of metal is preferred.

In order to be able to provide the engaging relationship between the cup-shaped portion and the flange of the lamp holder and, in addition, to be able to provide electrical contact between the first and second contact members and the first and second connection means in the base portion of the lamp holder, the base portion is constructed in a special fashion. To this end a preferred embodiment of the assembly according to the invention is characterized in that a cylindrical body of an insulating material is arranged with clearance in the base portion of the lamp holder and a resilient means is provided between the cylindrical body and the flange of the lamp holder, the cylindrical body engaging, under resilient pressure, the flange when the flange receives the cup-shaped portion. The cylindrical body is relatively free to move in the base portion of the lamp holder as long as the flange of the lamp holder is separate form the cup-shaped portion. When the flange receives the cup-shaped portion, the position of the cylindrical body becomes relatively fixed. Upon inserting the cup-shaped portion into the flange of the lamp holder, the cylindrical body is pulled in the direction of the discharge lamp, thereby exerting pressure on the resilient means between the cylindrical body and the flange of the lamp holder. In this manner the height of the discharge lamp with respect to the lamp holder is determined only by the engaging relationship between the cup-shaped portion and the flange of the lamp holder. In this manner the light-center length along the longitudinal axis is accurately determined.

From a constructional point of view the cylindrical body is preferably built from two adjacent parts. One part provides that the cylindrical body is pulled in the direction of the discharge lamp when the cup-shaped portion is inserted into the flange of the lamp holder, whereas the other part comprises the electrical connection means. To this end a preferred embodiment of the assembly according to the invention is characterized in that the cylindrical body comprises a first cylindrical portion and an adjacent second cylindrical portion on a side of the first cylindrical portion facing away from the capped high-pressure discharge lamp, the first cylindrical portion being provided with a first and a second arc-shaped slot, which slots are provided at one end with a circular widening for passing the first and second contact members when the flange of the lamp holder receives the cup-shaped portion of the capped high-pressure discharge lamp, the first and second contact members of the base portion making electrical contact with the first and second connection means after rotation of the first and second contact members in the arc-shaped slots, the first and second connection means being provided in the second cylindrical portion. The arc-shaped slots provided with a circular widening at one end enable the insertion of the contact members according to a so-called twist and lock mechanism. The first and second contact members are inserted in the circular widening of the first and a second arc-shaped slot when the flange of the lamp holder receives the cup-shaped portion of the capped high-pressure discharge lamp. As a next step the cup-shaped portion is twisted until the first and second contact members of the base portion make (mechanical and) electrical contact with the first and second connection means in the second cylindrical portion of the cylindrical body. The rotation of the first and second contact members in the arc-shaped slot provides the movement of the first cylindrical portion of the cylindrical body in the direction of the discharge lamp. Due to this movement, pressure is exerted on the resilient means between the first cylindrical portion and the flange of the lamp holder.

In this manner the height of the discharge lamp with respect to the lamp holder is determined only by the engaging relationship between the cup-shaped portion and the flange of the lamp holder. In this manner the light-center length along the longitudinal axis is accurately determined.

A preferred embodiment of the assembly according to the invention is characterized in that the first and second cylindrical portion are made from a ceramic material. The use of ceramic materials, such as aluminum oxide, is suitable because of the relatively high temperatures of the discharge lamp.

In another preferred embodiment of the assembly according to the invention the cylindrical body is provided with hampering means hampering the rotation around the longitudinal axis of the first and second cylindrical portions with respect to each other. To this end the first and second cylindrical portions are provided with suitable protruding and indented parts. In this manner, the orientation of the first and second cylindrical portions with respect to each other around the longitudinal axis is limited. Preferably, the first and second cylindrical portions are attached to each other by retention springs or by rivets. The retention springs allow some movement, in particular along the longitudinal axis, of the first and second cylindrical portions of the cylindrical body in the base portion of the lamp holder with respect to each other. Preferably, the first and second cylindrical portions are fixed to each other, thereby hampering the movement of the first and second cylindrical portions with respect to each other.

Another preferred embodiment of the assembly according to the invention is characterized in that the first and second contact members are provided with a shank, the shank being provided with a disc on a side of the shank facing away from the cup-shaped portion, the disc having a dimension allowing passage through the circular widening of the slots, the shanks having a smaller dimension allowing passage through the first and second arc-shaped slots. The shanks and discs of the first and second contact members cooperate with the arc-shaped slots provided with a circular widening at one end according to the twist and lock mechanism.

Another favorable embodiment of the assembly according to the invention is characterized in that the base portion of the lamp cap is provided with a protruding portion cooperating with a complementary indented portion in the first cylindrical portion of the cylindrical body. The cooperation between the protruding portion in the base portion of the lamp cap and the indented portion in the first cylindrical portion of the cylindrical body are convenient to ensure, for instance, that the discharge lamp is always inserted in a certain orientation into the lamp holder. In principle there are two possible orientations of the discharge lamp with respect to the lamp holder. In one orientation the first electrode in the discharge vessel is connected to the first connection means in the lamp holder (via the first current-supply conductor and the first contact means) and in the other orientation the first electrode in the discharge vessel is connected to the second connection means in the lamp holder (also via the first current-supply conductor and the first contact means). It can be desirable to ignite the discharge in the discharge vessel starting always at a certain electrode, for instance that electrode which is closest to the pinched portion of the outer envelope. In that case the orientation of the discharge vessel is determined when the flange of the lamp holder receives the cup-shaped portion of the capped high-pressure discharge lamp.

The invention also relates to a capped high-pressure discharge lamp for use in such an assembly.

The invention further relates to a lamp holder for use in such an assembly.

The invention will now be explained in more detail with reference to a number of embodiments and a drawing, in which.

The Figures are purely diagrammatic and not drawn true to scale. Some dimensions are strongly exaggerated for reasons of clarity. Equivalent components have been given the same reference numerals as much as possible in the Figures.

Figure 1:
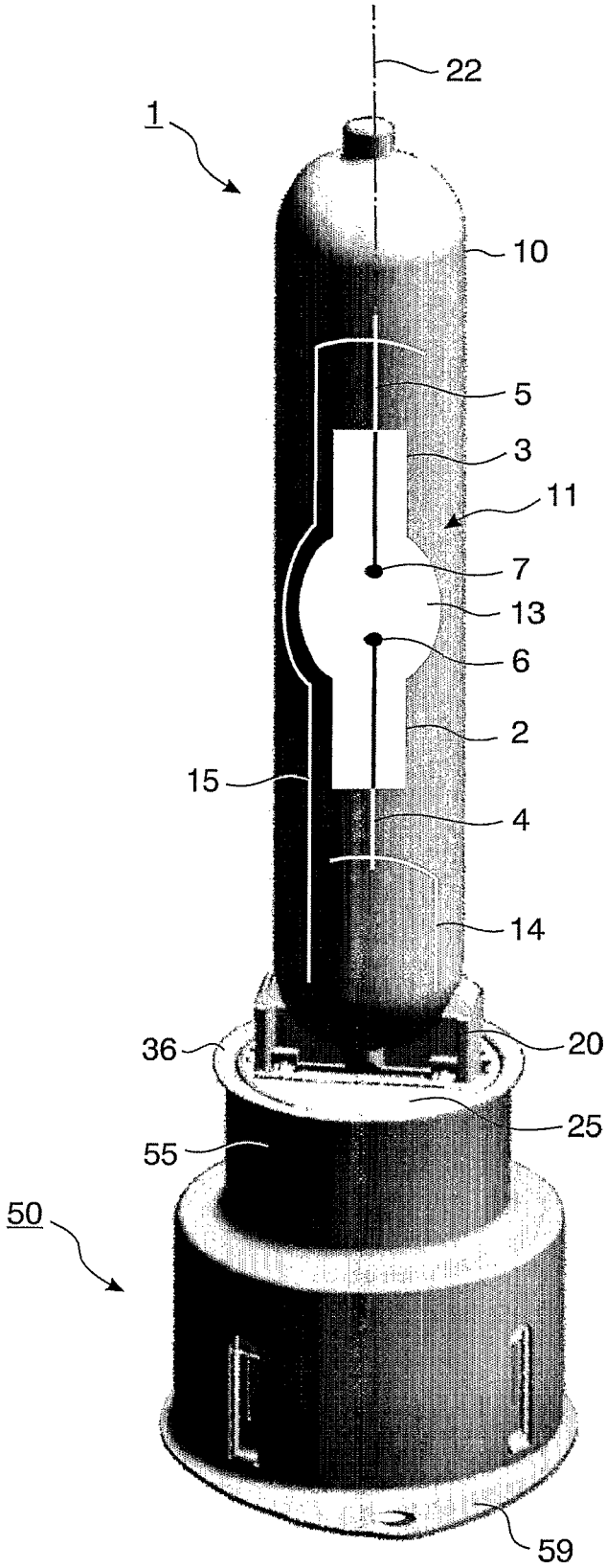
FIG. 1 shows a perspective side view of an embodiment of the assembly of a capped high-pressure discharge lamp 1 and a lamp holder 50.

FIG. 1 very diagrammatically shows a perspective side view of an embodiment of the assembly of a capped high-pressure discharge lamp 1 and a lamp holder 50. The capped high-pressure discharge lamp 1 comprises an outer envelope 10 in which a discharge vessel 11 is arranged around a longitudinal axis 22. The discharge vessel 11 encloses, in a gastight manner, a discharge space 13 provided with an ionizable filling comprising mercury, metal halides or metals and a rare gas. In the example of FIG. 1, the discharge vessel 11 has a first 2 connection portion and a second 3 opposite connection portion through which a first 4 and a second 5 current-supply conductor, respectively, extend to a pair of electrodes 6, 7 arranged in the discharge space 13. Preferably, the connection portions 2, 3 are so-called neck-shaped portions. In an alternative embodiment the discharge vessel is cylindrically shaped over its entire length. In the example of FIG. 1, the outer envelope 10 has a pinched portion 20. The pinched portion 20 supports the discharge vessel 11 via the first and second current-supply conductors 4, 5. In the example of FIG. 1, a first connection conductor 14 provided in the pinched portion 20 is connected to the second current-supply conductor 4. In addition, a second connection conductor 15 provided in the pinched portion 20 runs alongside the discharge vessel and is connected to the second current-supply conductor 5. The pinched portion 20 of the outer envelope 11 is provided with a clamping member 25 surrounding the pinched portion 20 with a clamping fit. In addition, a lamp holder 50 is shown in FIG. 1 having a substantially circular-cylindrical flange 55 for receiving the capped high-pressure discharge lamp 1. The lamp holder 50 is provided with a bottom portion 59 for mounting the assembly.

The bottom portion 59 is the reference plane for the system of fits according to the invention. The accuracy is obtained, on the one hand, by the relatively small tolerances on the height of the lamp holder 50 and the relatively small tolerances on the flange 55, and, on the other hand, by the small tolerances on the outer diameter of the cup-shaped portion 33 and the protruding collar 36 which both are used as the reference during the adjustment of the burner in the manufacturing process.

Figure 2:
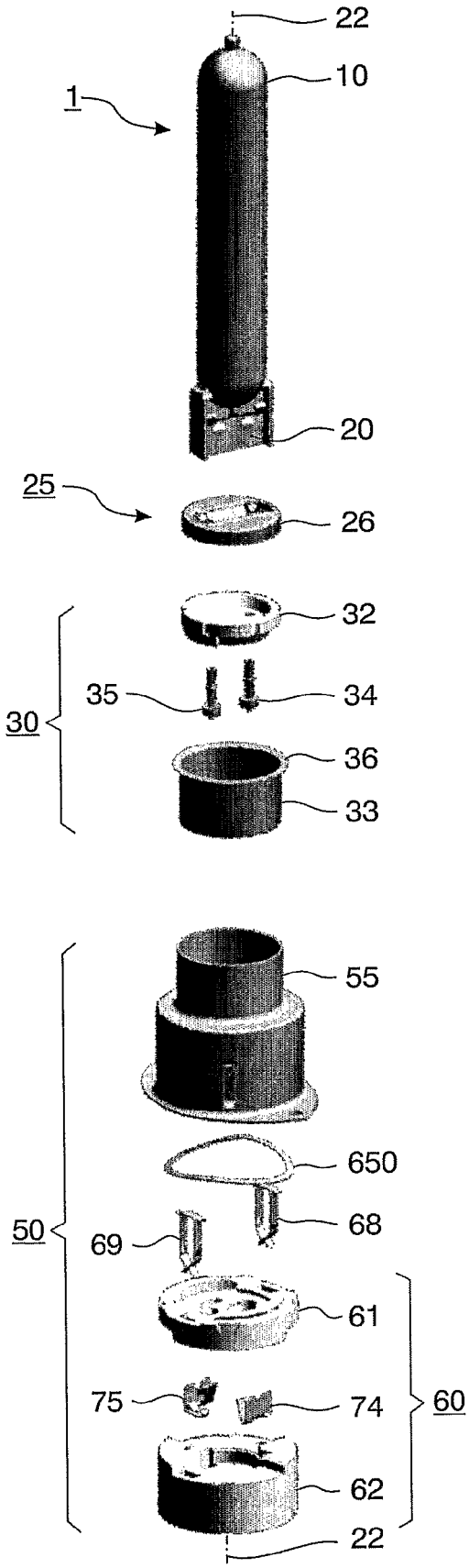
FIG. 2 shows an exploded perspective view of an embodiment of the assembly of a capped high-pressure discharge lamp 1 and a lamp holder 50.

FIG. 2 shows an exploded perspective view of an embodiment of the assembly of a capped high-pressure discharge lamp 1 and a lamp holder 50. For clarity, FIG. 2 shows the various elements of the assembly at a certain distance with respect to each other; in addition, the discharge vessel 11 has been omitted in FIG. 2. In FIG. 2, a lamp cap 30 is shown having a base portion 32 of an insulating material and a substantially circular-cylindrical cup-shaped portion 33 for receiving the clamping member 25. The base portion 32 is provided with a first 34 and a second 35 contact member projecting beyond the cup-shaped portion 33 (also see FIG. 4). In the assembled state of the capped high-pressure discharge lamp 1 and the lamp holder 50, the first and second current-supply conductors 4, 5 are electrically connected to the first and second contact members 34, 35, respectively. The cup-shaped portion 33 is provided with a protruding collar 36 for engagement with the flange 55 of the lamp holder 50.

In FIG. 2, the lamp holder 50 comprises a base portion 60 and a substantially circular-cylindrical flange 55 for receiving the cup-shaped portion 33 of the capped high-pressure discharge lamp 1. In addition, the base portion 60 is provided with first 74 and second 75 connection means.

In the assembled state of the capped high-pressure discharge lamp 1 and the lamp holder 50, the flange 55 of the lamp holder 50 receives the cup-shaped portion 33 of the capped high-pressure discharge lamp 1 such that the flange 55 engages the protruding collar 36 of the cup-shaped portion 33. In addition, the first and second contact members 34, 35 make electrical contact with the first and second connection means 74, 75, respectively, when the flange 55 receives the cup-shaped portion 33.

In order to position the discharge vessel 11 of the capped high-pressure discharge lamp 1 with relatively high accuracy in the lamp holder 50, an inner diameter of the flange 55 has a tolerance of less than or equal to −0.2 mm and an outer diameter of the cup-shaped portion 33 has a tolerance of less than or equal to +0.2 mm. These respective tolerances extend over a length of at least 2.5 mm, measured from the protruding collar 36 along the longitudinal axis 22 in a direction facing away from the discharge vessel 11.

Upon receiving the cup-shaped portion 33 of the capped high-pressure discharge lamp 1, the flange 55 of the lamp holder 50 engages the protruding collar 36 of the cup-shaped portion 33. This engaging relationship between the cup-shaped portion 33 and the flange 55 determines the height of the discharge vessel 11 with respect to the lamp holder 50. In this manner the light-center length along the longitudinal axis 22 is accurately determined. The position of the center of the light discharge in a plane perpendicular to the longitudinal axis is determined by the tolerances of the respective diameters of the flange 55 of the lamp holder 50 and the cup-shaped portion 33 of the capped high-pressure discharge lamp 1. The higher the requirement concerning the tolerance of the respective diameters, the better the center of the light discharge is positioned on the longitudinal axis 22.

Preferably, the inner diameter of the flange 55 has a tolerance of less than or equal to −0.10 mm and the outer diameter of the cup-shaped portion 33 has a tolerance of less than or equal to +0.05 mm, the respective tolerances extending over a length of at least 5 mm, measured with respect to the protruding collar 36 along the longitudinal axis 22. Specifying relatively narrow tolerances for the respective diameters of the flange 55 of the lamp holder 50 and the cup-shaped portion 33 enables the positioning of the cup-shaped portion 33 into flange 55 with relatively high accuracy. In this manner, the discharge vessel 11 of the capped high-pressure discharge lamp 1 can be positioned with relatively high accuracy in the lamp holder 50.

In order to improve the accuracy of the position of cup-shaped portion 33 of the capped high-pressure discharge lamp 1 in the flange 55 of the lamp holder 50, the mounting of the clamping member 25 in the lamp cap 30 can be improved. To this end, the clamping member 25 is provided with a substantially circular-cylindrical engagement portion 26 for fixing the clamping member 25 in the cup-shaped portion 33. The engagement portion 26 enhances the fit of the clamping member 25 in the cup-shaped portion 33. In addition, the engagement portion 26 can be used to provide a rigid connection, for instance by spot welding, between the clamping member 25 and the cup-shaped portion 33.

In order to meet the requirements of the relatively high accuracy of mounting the cup-shaped portion 33 of the lamp cap 30 in the lamp holder 50, the cup-shaped portion 33 and the flange 55 of the lamp holder 50 are, preferably, made from metal. A suitable metal is stainless steel.

In FIG. 2, a cylindrical body 60 of an insulating material is arranged with clearance in the base portion 60 of the lamp holder 50 and a resilient means 65 is provided between the cylindrical body 60 and the flange 55 of the lamp holder 50. The cylindrical body 60 engages, under resilient pressure, the flange 55 when the flange 55 receives the cup-shaped portion 33. To this end, the diameter of the flange 55 is chosen smaller than the diameter of the base portion 60. In addition, the cylindrical body 60 has a first cylindrical portion 61 and an adjacent second cylindrical portion 62 on a side of the first cylindrical portion 61 facing away from the capped high-pressure discharge lamp 1. The first and second contact members 34, 35 of the base portion 32 make electrical contact with the first and second connection means 74, 75.

Preferably, the cylindrical body 60 is provided with hampering means hampering the rotation around the longitudinal axis 22 of the first and second cylindrical portions 61, 62 with respect to each other. Preferably, the first and second cylindrical portions 61, 62 are attached to each other by retention springs 68, 69. In an alternative embodiment the first and second cylindrical portions 61, 62 are attached to each other by rivets. Preferably, the first and second cylindrical portions 61, 62 are attached to each other in such a way that movement between the first and second cylindrical portions 61, 62 is not possible.

Preferably, the base portion 32 of the lamp cap 30 is provided with a protruding portion cooperating with a complementary indented portion in the first cylindrical portion 61 of the cylindrical body.

Figure 3:
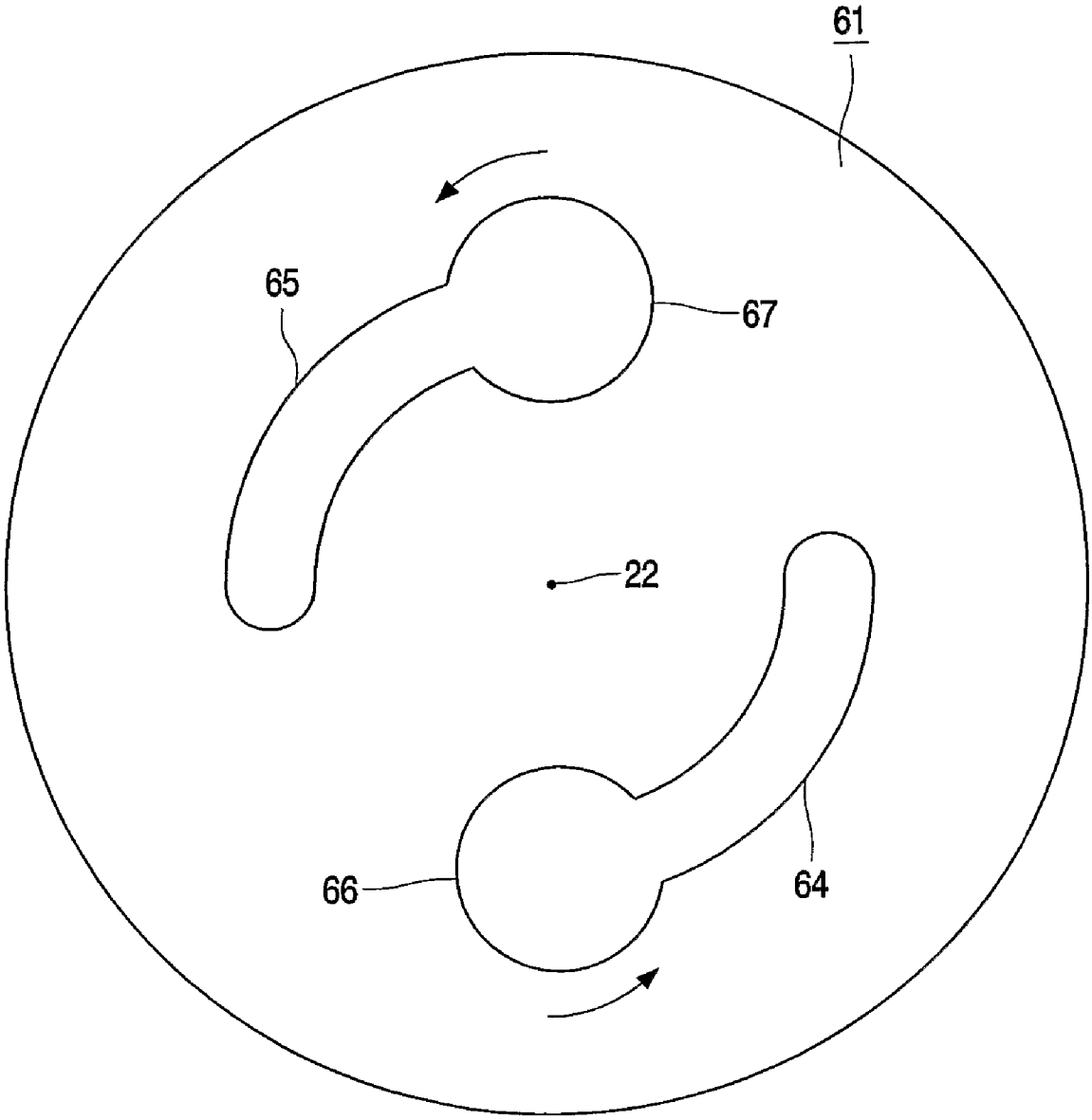
FIG. 3 shows the first cylindrical portion of the base portion in a cross-section perpendicular to the longitudinal axis.

FIG. 3 schematically shows the first cylindrical portion 61 of the base portion 60 in a cross-section perpendicular to the longitudinal axis 22. The first and second cylindrical portion 61, 62 are preferably made from a ceramic material. Suitable ceramic materials are aluminum oxide and aluminum oxide with suitable additives, such as Mg, Ca or rare-earth metals. Ceramic materials are very suitable because of their ability to withstand the relatively high temperatures of the discharge lamp. The first cylindrical portion 61 is provided with a first 64 and a second 65 arc-shaped slot, which slots 64, 65 are provided at one end with a circular widening 66, 67 for passing the first and second contact members 34, of the capped high-pressure discharge lamp 2 when the flange 55 of the lamp holder 50 is inserted into the cup-shaped portion 33 of the capped high-pressure discharge lamp 1 (also see FIG. 2). As a next step the capped high-pressure discharge lamp 1 is rotated in the direction indicated by the arrows in FIG. 3 until the first and second contact members 34, of the capped high-pressure discharge lamp 2 make contact with the first and second connection means 74, 75 provided in the second cylindrical portion 62. The rotation of the first and second contact members 34, 35 in the arc-shaped slots 64, 65 provides the movement of the first cylindrical portion 61 of the cylindrical body 60 in the direction of the discharge vessel 11. Due to this movement, pressure is exerted on the resilient means 65°between the first cylindrical portion 61 and the flange 55 of the lamp holder 50. In this manner the height of the discharge vessel 11 with respect to the lamp holder 50 is only determined by the engaging relationship between the cup-shaped portion 33 and the flange 55 of the lamp holder 50. In this manner the light-center length along the longitudinal axis 22 is accurately determined.

Figure 4:
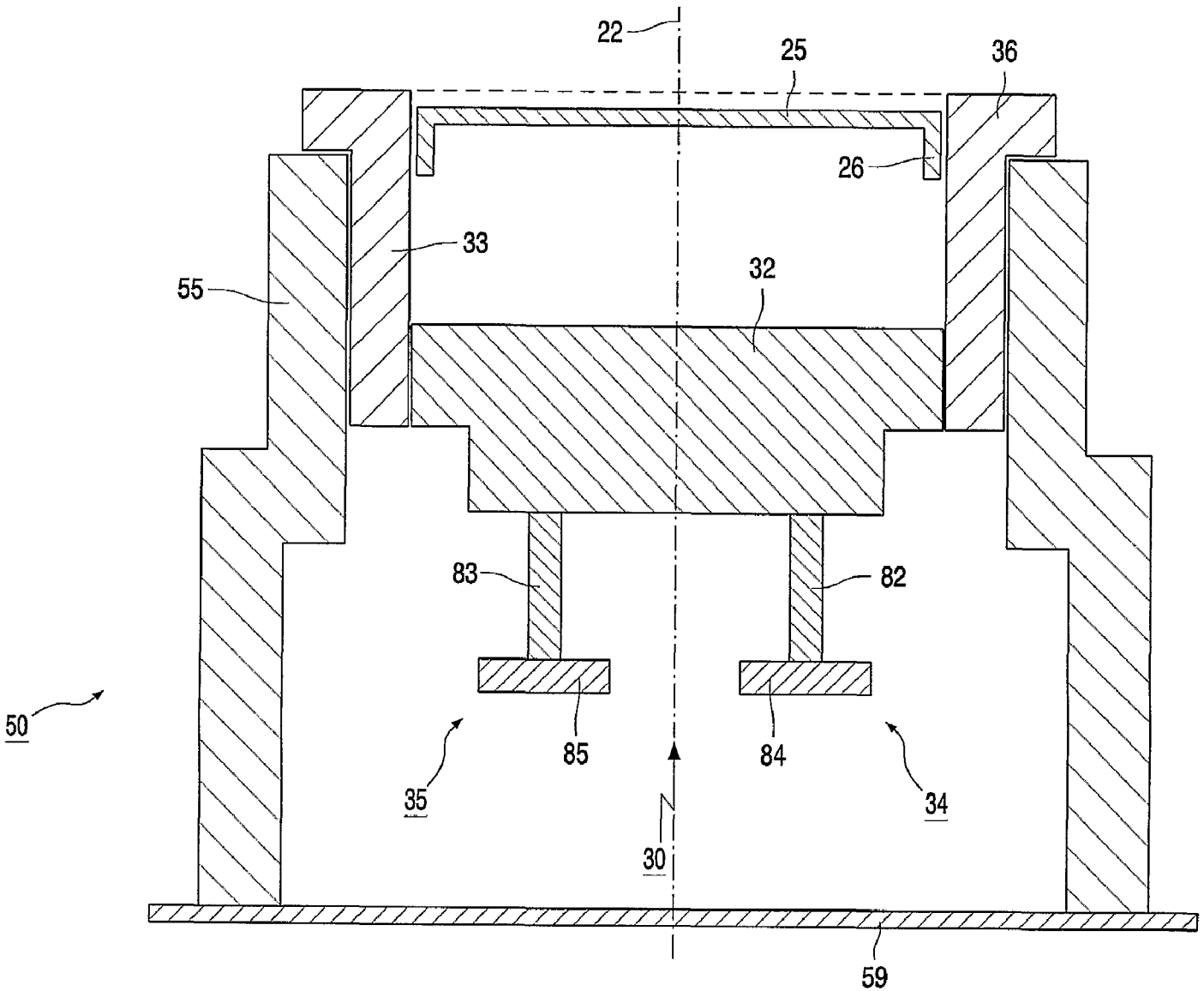
FIG. 4 shows a cross-section of the lamp holder and the lamp cap comprising the cup-shaped portion and the base portion provided with the first and second contact members.

FIG. 4 schematically shows a cross-section of the lamp holder 50 and the lamp cap 30 comprising the substantially circular-cylindrical cup-shaped portion 33 provided with the protruding collar 36 and the base portion 32 provided with the first and second contact member 34, 35. The first and second contact members 34, 35 are provided with a shank 82, 83. Each shank 82, 83 is provided with a disc 84, 85 on a side of the shank 82, 83 facing away from the cup-shaped portion 33. The discs 84, 85 have a dimension allowing passage through the circular widening 66, 67 of the slots 64, 65 in the first cylindrical portion 61 (for clarity the first and second cylindrical portion 61, 62 are not shown in FIG. 4). The shanks 82, 83 have a smaller dimension allowing passage through the first and second arc-shaped slots 64, 65 in the first cylindrical portion 61 (see FIG. 3).

FIG. 4 also shows the clamping member 25 mounted in the base portion 32 of the lamp cap 30. The clamping member 25 is provided with a substantially circular-cylindrical engagement portion 26 for fixing the clamping member 25 in the cup-shaped portion 33.

FIG. 4 also shows the lamp holder 50 with the flange 55. In the example of FIG. 4 the flange 55 of the lamp holder 50 has received the cup-shaped portion 33 of the capped high-pressure discharge lamp 1. The flange 55 engages the protruding collar 36 of the cup-shaped portion 33. In a very favorable embodiment of the assembly, the inner diameter of the flange 55 has a tolerance of less than or equal to −0.05 mm and the outer diameter of the cup-shaped portion 33 has a tolerance of less than or equal to +0.1 mm, the respective tolerances extending over a length of approximately 10 mm, measured with respect to the protruding collar 36 along the longitudinal axis 22. The lamp holder 50 is provided with a bottom portion 59 for mounting the assembly.

Preferably, the second cylindrical portion 61 is provided with an indented surface for engagement with the first and second contact members 34, 35. During rotation of the first and second contact members 34, 35 in the arc-shaped slots 64, 65, the discs 84, 85 move along the indented surface, enabling the buildup of sufficient strength for establishing a firm grip of the cup-shaped portion 33 of the capped high-pressure discharge lamp 1 in the flange 55 of the lamp holder 50. The indented surface cooperating with the first and second contact member 34, 35 establishes the reference engagement of the protruding collar 36 of the cup-shaped portion 33 and the flange 55 of the lamp holder 50.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An assembly of a capped high-pressure discharge lamp and a lamp holder, comprising:

a capped high-pressure discharge lamp comprising:

an outer envelope in which a discharge vessel is arranged around a longitudinal axis, the discharge vessel enclosing, in a gastight manner, a discharge space provided with an ionizable filling, the discharge vessel having a first connection portion and a second opposite connection portion through which a first and a second current-supply conductor, respectively, extend to a pair of electrodes arranged in the discharge space, the outer envelope having a pinched portion supporting the discharge vessel via the first and second current-supply conductors, the pinched portion being provided with a clamping member surrounding the pinched portion with a clamping fit;

a lamp cap having a base portion of an insulating material and a substantially circular-cylindrical cup-shaped portion for receiving the clamping member, the cup-shaped portion being provided with a protruding collar, the base portion being provided with a first and a second contact member projecting beyond the cup-shaped portion, the first and second current-supply conductors being electrically connected to the first and second contact members, respectively; and a lamp holder comprising:

a base portion and a substantially circular-cylindrical flange for receiving the cup-shaped portion of the capped high-pressure discharge lamp, a cylindrical body of an insulating material arranged with clearance in the base portion of the lamp holder and a resilient means between the cylindrical body and the flange of the lamp holder, the cylindrical body engaging, under resilient pressure, the flange when the flange receives the cup-shaped portion;

the base portion being provided with first and second connection means, wherein the flange of the lamp holder receives the cup-shaped portion of the capped high-pressure discharge lamp such that the flange engages the protruding collar of the cup-shaped portion and the first and second contact members make electrical contact with the first and second connection means, respectively.

2. The assembly of claim 1, wherein an inner diameter of the flange has a tolerance of less than or equal to −0.2 mm, an outer diameter of the cup-shaped portion has a tolerance of less than or equal to +0.2 mm, the respective tolerances extending over a length of at least 2.5 mm measured with respect to the protruding collar along the longitudinal axis.

3. The assembly of claim 1, wherein the inner diameter of the flange has a tolerance of less than or equal to −0.10 mm and the outer diameter of the cup-shaped portion has a tolerance of less than or equal to +0.05 mm, the respective tolerances extending over a length of at least 5 mm, measured with respect to the protruding collar along the longitudinal axis.

4. The assembly of claim 1, wherein the clamping member has a substantially circularly-cylindrical engagement portion for fixing the clamping member in the cup-shaped portion.

5. The assembly of claim 1, wherein the cup-shaped portion of the lamp cap and the flange of the lamp holder are made from a metal.

6. The assembly of claim 1, the cylindrical body comprising a first cylindrical portion and an adjacent second cylindrical portion on a side of the first cylindrical portion facing away from the capped high-pressure discharge lamp;

the first cylindrical portion being provided with a first and a second arc-shaped slot, which slots are provided at one end with a circular widening for passing the first and second contact members when the flange of the lamp holder receives the cup-shaped portion of the capped high-pressure discharge lamp;

the first and second contact members of the base portion making electrical contact with the first and second connection means after rotation of the first and second contact members in the arc-shaped slots, the first and second connection means being provided in the second cylindrical portion.

7. The assembly of claim 1, wherein the first and second cylindrical portion are made from a ceramic material.

8. The assembly of claim 1, wherein the cylindrical body is provided with hampering means hampering the rotation around the longitudinal axis of the first and second cylindrical portions with respect to each other.

9. The assembly of claim 1, wherein the first and second cylindrical portions are attached to each other by retention springs or by rivets.

10. The assembly of claim 1, wherein the first and second contact members are provided with a shank, the shank being provided with a disc on a side of the shank facing away from the cup-shaped portion, the disc having a dimension allowing passage through the circular widening of the slots, the shanks having a smaller dimension allowing passage through the first and second arc-shaped slots.

11. The assembly of claim 1, wherein the base portion of the lamp cap is provided with a protruding portion cooperating with a complementary indented portion in the first cylindrical portion of the cylindrical body.

12. A lamp holder for use in the assembly of claim 1, the lamp holder comprising:

a base portion and a substantially circular-cylindrical flange for receiving the cup-shaped portion of the capped high-pressure discharge lamp, a cylindrical body of an insulating material arranged with clearance in the base portion of the lamp holder and a resilient means between the cylindrical body and the flange of the lamp holder, the cylindrical body engaging, under resilient pressure, the flange when the flange receives the cup-shaped portion;

the base portion being provided with first and second connection means, wherein the flange of the lamp holder receives the cup-shaped portion of the capped high-pressure discharge lamp such that the flange engages the protruding collar of the cup-shaped portion and the first and second contact members make electrical contact with the first and second connection means, respectively.

13. The lamp holder of claim 12, wherein an inner diameter of the flange has a tolerance of less than or equal to –0.2 mm.

14. An illumination system comprising an assembly of a capped high-pressure discharge lamp and a lamp holder according to claim 1.

15. A method for illuminating an outdoor or indoor area comprising providing an illumination system according to claim 14, providing electrical power to the illumination system, and illuminating the outdoor or indoor area with light from the illumination system.

* * * * *